US005997094A

United States Patent [19]

Cvek

[11] Patent Number: 5,997,094

[45] Date of Patent: Dec. 7, 1999

[54] STACKABLE CHAIR WITH LUMBAR SUPPORT

[75] Inventor: Sava M. Cvek, Jamaica Plain, Mass.

[73] Assignee: Stylex, Inc., Delanco, N.J.

[21] Appl. No.: 09/092,367

[22] Filed: Jun. 5, 1998

[51] Int. Cl.[6] ..... A47C 7/02

[52] U.S. Cl. ..... 297/452.15; 297/448.2; 297/284.4; 297/239

[58] Field of Search ..... 297/285, 301.1, 297/239, 452.15, 452.14, 452.12, 452.31, DIG. 2, 452.3, 452.29, 451.11, 284.4, 448.1, 448.2, 344.1

[56] References Cited

U.S. PATENT DOCUMENTS

| | | | |
|---|---|---|---|
| 3,724,897 | 4/1973 | Faiks et al. | 297/239 X |
| 4,418,958 | 12/1983 | Watkin | 297/452.15 |
| 4,529,247 | 7/1985 | Stumpf et al. | 297/452.15 X |
| 4,648,653 | 3/1987 | Rowland | 297/239 |
| 5,064,247 | 11/1991 | Clark et al. | 297/239 X |
| 5,123,702 | 6/1992 | Caruso | 297/239 |
| 5,407,247 | 4/1995 | Forcier et al. | 297/452.15 X |
| 5,577,811 | 11/1996 | Ogg | 297/452.15 |

*Primary Examiner*—Milton Nelson, Jr.
*Attorney, Agent, or Firm*—Stuart E. Beck

[57] ABSTRACT

An ergonomic chair having a shell that defines a seat and a back. The shell includes a lower back support that extends upwardly from the rear of its seat to about the middle of the back of the chair. An upper back support also extends upwardly from the rear of its seat. The upper and lower back supports can be resiliently flexed independently of each other to respond to movement of the user's back against the back. The shell is mounted to a base which enables multiple identical chairs to be telescopically stacked in a space-saving configuration.

19 Claims, 6 Drawing Sheets

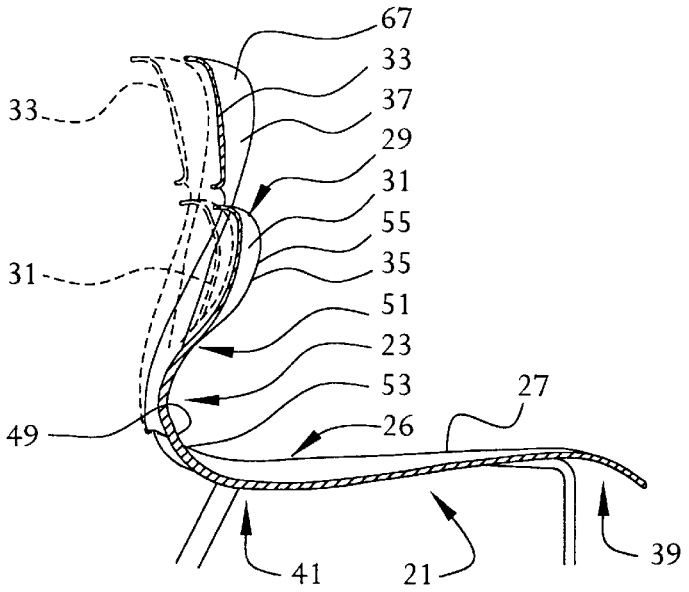
FIG. 8
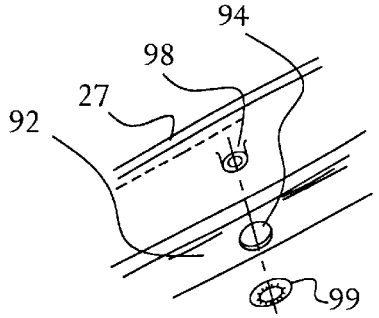
FIG. 10A
FIG. 10B
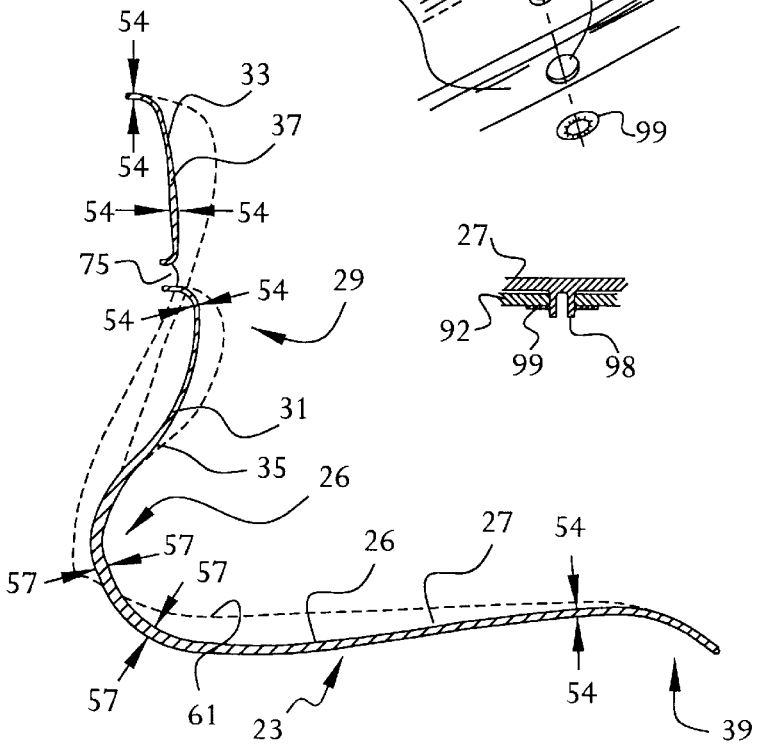
FIG. 9

STACKABLE CHAIR WITH LUMBAR SUPPORT

FIELD OF THE INVENTION

This invention relates to chairs and, more particularly, to a stackable chair with a structure which supports the lumbar region of the person seated thereon.

BACKGROUND OF THE INVENTION

It is known to provide chairs with backrests, especially when such chairs are for use in offices or other environments where prolonged sitting is likely. Such chairs generally take the form of an inner shell with suitable padding or upholstery fitted over the shell, such as shown in Kaneda U.S. Pat. No. 5,102,196. The resulting seat portion of such chairs is generally supported on a pedestal or similar support structure.

Although such chairs are generally comfortable, they have various drawbacks and disadvantages. For example, the support structures for these ergonomically designed chairs make them difficult if not impossible to stack on each other in a telescoping and space-saving configuration, either because of the design of the support structures themselves or their inherent weight.

Furthermore, the inability to stack such chairs means that they are cumbersome and difficult to store. The storage disadvantage becomes magnified when there are multiple chairs involved, such as may be found around a table, in a conference room, or in any environment where the seating of multiple persons is the norm.

Another disadvantage to the ergonomic chairs of the current art is that they tend to be mechanically and structurally complex. As such, the chairs may be difficult or non-intuitive to operate, or otherwise require an "owners manual" to be effectively used. The structural complexity also makes such chairs expensive to manufacture and purchase.

Although chairs of the current art have adjustable settings for the backrest, seat height, tilt, etc., the chairs are generally adjusted for the size, weight, and habits of one particular user at time. As such, the interchangability of such ergonomic chairs is inherently limited: another user must content him- or herself with the settings of the previous user, which may not be ergonomically optimal; or such other user must go through the sometimes painstaking process of readjusting the chair to obtain make it comfortable or ergonomic.

As a further disadvantage, the adjustments to an ergonomic chair which are optimal for certain seated activities may be sub-optimal or otherwise inappropriate for other activities. In other words, ergonomic chairs of the current art often treat the seated individual as relatively static over time, merely occupying three-dimensional space. Such an approach ignores that the seated user is occupying the three dimensional space over a period of time, during which the user is engaged in a variety of activities, each with its own ergonomic demands or requirements. Chairs of the current art are frequently unable to adapt to the different ergonomic requirements of such different activities taking place over time in the chair.

When an ergonomic chair is inappropriately adjusted either for the user or for the user's activity, this often means that a complex and expensive piece of equipment is not being appropriately used. Such a poorly adjusted chair will result in pressure being exerted on the seated user at inappropriate locations. Such pressure makes the user uncomfortable at a minimum, and is likely to fatigue or otherwise debilitate the person seated in the maladjusted chair over time.

Attempts at solving the foregoing drawbacks and disadvantages have generated their own shortcomings. For example, on the other end of the spectrum from the structurally complex, non-stacking chair, is the basic, L-shaped, stackable chair with an open tubular or wire frame support. The legs of the frame are flared or otherwise structured so that the basic L-shaped chairs can be stacked one atop the other in a telescoping fashion to save storage space.

In order for such chairs to be stacked on each other, however, the design generally sacrifices most, if not all, of its ergonomic features. For example, the seat portions of such chairs must generally remain in an L-shape in order to be stacked, and such L-shape does not conform well to the curves of the user's back, particularly the lumbar or lower back region thereof.

Prior art attempts to maintain in a single chair design both the convenience of stacking as well as ergonomic features have had mixed results. U.S. Pat. No. 4,418,9582 to Watkin is an example of such prior attempts. Although chair shell disclosed in the Watkin patent is formed of a resilient material such as polypropylene, it does not provide sufficient ergonomic support to the user. For example, it is desirable to maintain a certain amount of independent motion between the areas of the chair seat which are supporting the bottom, lower back, and upper back, respectively, of the seated user, and the one-piece shell of Watkin does not provide a sufficient amount of such independent motion in a manner consistent with ergonomic principles.

Accordingly, there is a need for a chair with improved back support, particularly in the so-called lumbar or lower-back region, and with improved ergonomic features of the chair seat. There is a need for such a chair also to be capable of being stacked with one or more identical chairs of the same general configuration.

There is a further need for such a chair to respond to the changing ergonomic needs of the user over time.

There is a still further need for such a chair to have substantially independent points of support for the users bottom, lower back, and upper back, respectively.

There is a yet a further need for such chair to be self-adjusting as between different users.

SUMMARY OF THE INVENTION

The invention provides an ergonomic chair which includes an L-shaped shell formed from an integral piece of resilient material. In one preferred embodiment, the shell is molded from a polymeric material. The shell is secured to a base and thus defines a generally horizontal seat and a generally vertical back. The seat has a front, a rear, and side edges extending between the front and the rear. The rear has outer portions which are adjacent to the side edges and a middle portion between the outer portions. A lower back support is defined in the back of the chair. The bottom of the lower back support is secured to the middle portion of the rear, and the lower back support has a curved surface extending upwardly from the rear and terminating in a first, free end. This first free end resiliently flexes in relation to the base of the chair when weight or force from a user is applied to the lower back support.

In accordance with another aspect of the present invention, the back has an upper back support defined therein. The upper back support is formed from a pair of bands which extend generally upwardly from the outer portions of the rear. A support section extends between and bridges the bands to define a second, free end. This free end, like the free end of the lower-back support, resiliently flexes in relation to the rear of the seat in response to weight or force applied by the user against the upper-back support.

In accordance still another aspect of the present invention, the chair is designed so that it can be telescopically received on the seat of a second chair. In this way, the chair of the present invention is able to be stacked on such second chair and in a space-saving configuration. The ability for the chair of the present invention to be telescopically placed atop another chair is accomplished by making the base in the form of a frame of interconnected members. The interconnected members include a pair of rear legs which are spaced further apart from each other than a pair of front legs. The legs of the chair and the seat mount define a space under the chair, and the rear legs partially define an opening into such space. As such, the narrower expanse spanned by the front legs is insertable through the opening defined by the rear legs and substantially all of the seat in the frame of the second chair can thus be received in the space of the first chair. The chairs of the telescopically received end stack one on top of another.

In accordance with yet another aspect of the present invention, the curved contour of the lower back support includes a first portion which is convex in relation to the seating surface of the chair, and a second portion which is concave in relation to the seating surface of the chair. The concave and the convex portions are adjacent to each other on the lower back support and thereby define a serpentine shape. The serpentine shape generally follows the corresponding S-shaped curve of the user's lower back.

BRIEF DESCRIPTION OF THE DRAWING

For purposes of illustrating the invention, there is shown in the drawings forms which are presently preferred; it is understood, however, that the invention is not limited to the precise arrangement and instrumentalities shown.

FIG. 8 is a side sectional view of the chair shown in FIGS. 1–7;

FIG. 9 is a schematic side sectional view of the shell of the chair of FIGS. 1–8;

FIGS. 10*a* and 10*b* are exploded and side sectional views, respectively, of a portion of the chair of FIGS. 1–9;

DETAILED DESCRIPTION OF THE PREFERRED EMBODIMENTS

Figure 1:
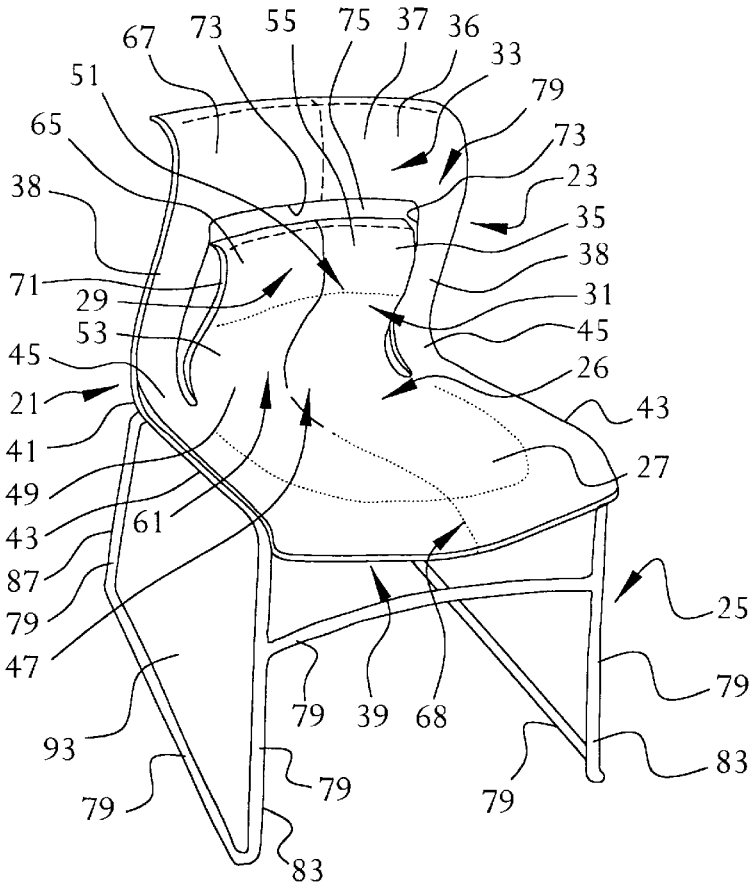
FIG. 1 is a perspective view of an ergonomic chair according to the present invention.
Figure 2:
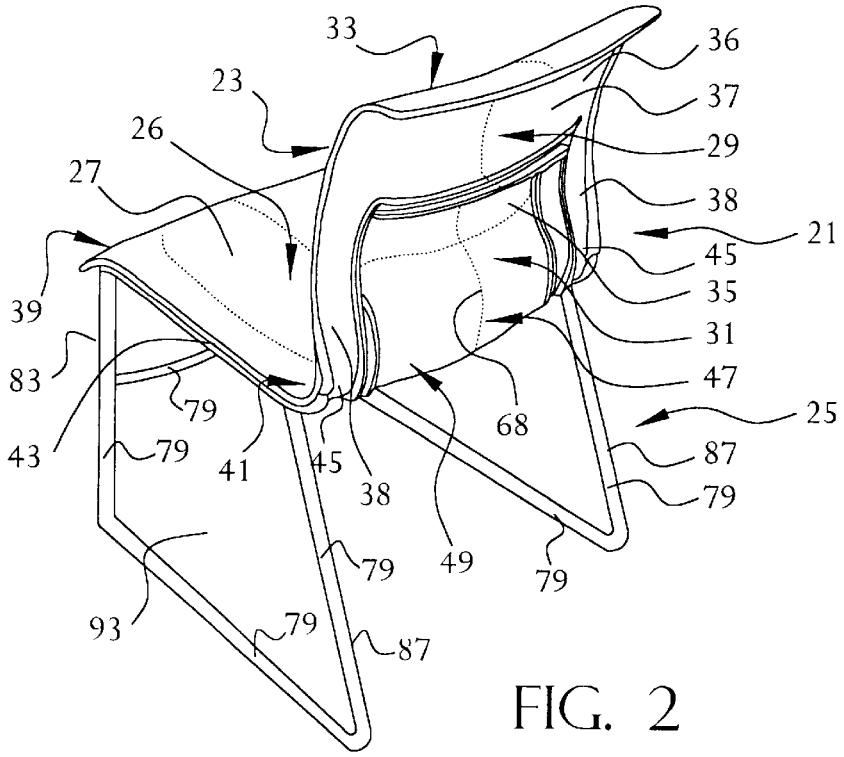
FIG. 2 is a rear, perspective view of the chair shown in FIG. 1.

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawing.

Referring now to FIGS. 1–10, an ergonomic chair 21 is generally formed from two, main components: an L-shaped shell 23 formed from an integral piece of resilient material, preferably a polymeric material; and a base 25 to which shell 23 is secured by suitable means. Shell 23 when secured to base 25 defines a generally horizontal seat 27 and a generally vertical back 29. Seat 27 and back 29 together have respective inner surfaces defining a seating surface 26 against which the user is seated. Seating surface 26 has a generally concave contour with the surface having a low point corresponding generally to axis 68. The generally concave contour of shell of seating surface 26 facilitates its engagement with the body of the user seated thereon.

An important aspect of the present invention is the division of back 29 into a lower back support 31 defined in the middle of back 29 and an upper back support 33 defined to the outside and above lower back support 31. This arrangement creates three, independent points of support for a user seated in chair 21, namely: the seat 27, the lower back support 31, and the upper back support 33. The two back supports 31, 33 extend generally upwardly from the rear of seat 27 and terminate in respective free ends 35, 37. The resilience and thickness of shell 23 is selected so that supports 31 and 33 resiliently flex from the position shown in solid lines in FIG. 8 to the position shown in phantom lines in response to weight or force exerted by the user's back.

The resilience of shell 23 and the flexing of supports 31 and 33 create a passive ergonomic environment which self-adjusts to the body shape of the user. Such environment also responds to different body movements of the user corresponding to different activities taking place while seated. For example, if the user arches his or her back toward the rear, upper back support 33 will be flexed rearward independently of lower back support 31. (Lower back support 31, in some cases, may also be flexed rearward by an independent, lesser amount.) As a further example, if the user sits up straight or hunches forward, it is likely that lower back support 31 will be flexed rearward, again independently of the position of upper back support 33.

Seat 27 has a front 39, a rear 41, and side edges 43 extending between front 39 and rear 41. Rear 41 of seat 27 has outer portions 45 located adjacent to the side edges 43, and a middle portion 47 located between outer portions 45. Lower back support 31 has a base 49 integral with the middle portion 47 of rear 41. A portion of the lower back support 31 includes a curved surface 51 that extends generally upwardly from base 49.

Curved surface 51 terminates in an upwardly extending free end 35 as mentioned previously. Curved surface 51 preferably includes two contiguous portions, the lower portion 53 which is concave around a horizontal axis in relation to the general contour of seating surface 26, and an upper portion 55 extending from lower portion 53, upper portion 55 being generally convex around a horizontal axis in relation to seating surface 26. These adjacent concave and convex portions 53, 55 together give curved surface 51 a serpentine shape which generally follows the corresponding S-shaped curve of the user's lower back which is likely to be resting against surface 51. The matching of the curved surface 51 to the user's lower back reduces fatigue and stress on the lower back.

Upper back support 33 is defined by a pair of elongated bands 38 which extend generally upwardly from outer portions 45 of rear 41 of seat 27. A support section 36 extends transversely between the upper ends of bands 38, thereby bridging the bands 38 and giving upper back support 33 the configuration of an inverted U. Support section 36 has an upper back support surface 67 which comprises part of the general seating surface 26. When the user's weight or force is exerted against upper back support surface 67, such force causes free end 37 to flex in relation to rear 41 of seat 27, as best seen by the phantom lines of FIG. 8.

Similarly, lower back support 31 has a lower back support surface 65 defined therein, the lower back support surface 65 comprising part of the overall seating surface 26 of chair 21.

Figure 3:
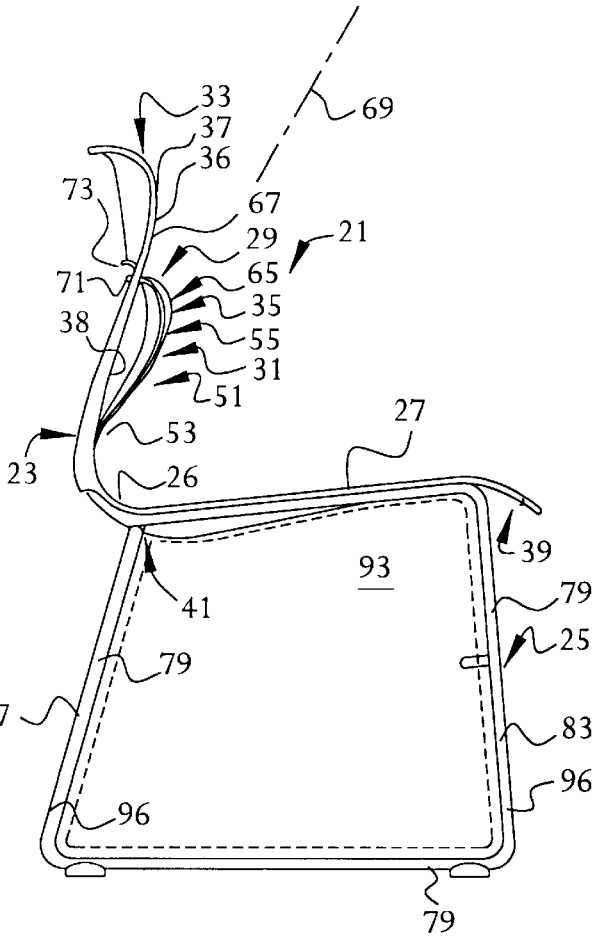
FIG. 3 is a side elevation view of the chair of FIGS. 1 and 2.
Figure 5:
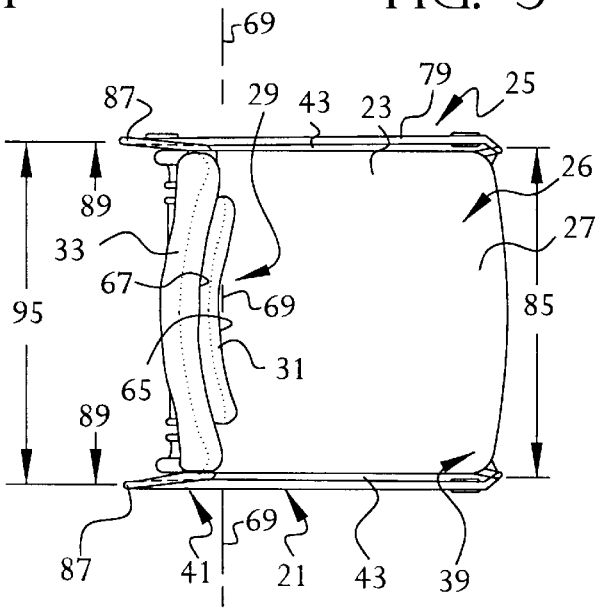
FIG. 5 is a top plan view of the chair of FIGS. 1–4.

As best as seen in FIGS. 3 and 5, lower back support surface 65 is generally coincident with a plane 69 which is oriented generally vertically at about 60° from the horizontal when the chair is unoccupied. Plane 69 is closer to front 39 of seat 27 than upper back support surface 67 is when the chair is empty as shown in the figures. The placement of lower back support surface 65 closer to front 39 than upper back support surface 67 is corresponds generally to ergonomic principals: the user's spine tends to have an inward curvature of the lower back, which curvature is taken into account by the more forward position of lower back support 31; and a rearward curvature of the upper back, which is taken into account by upper back support 33.

Figure 4:
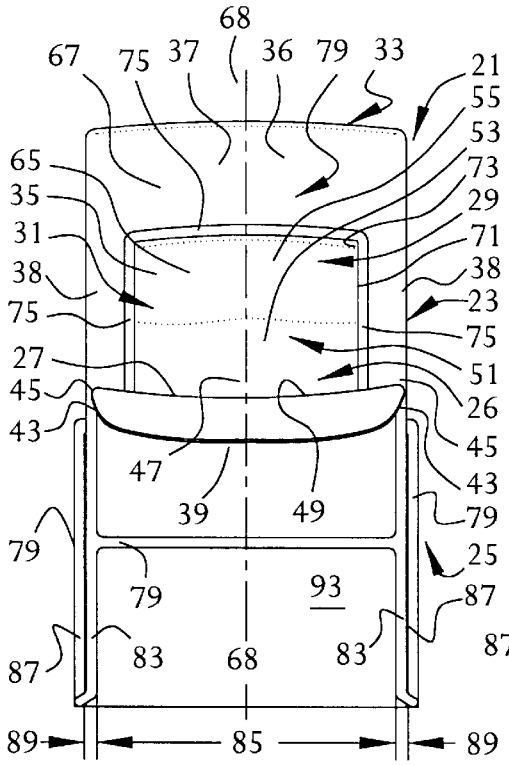
FIG. 4 is a front elevation view of the chair of FIGS. 1–3.

Refer now to FIGS. 1 and 4, lower back support 31 is in the form of an upwardly extending tab with a perimeter edge 71. Perimeter edge 71 opposes and is located near an inner edge 73 of upper back support 33. As such, lower back support 31 resembles a tab or flange in back 29 of chair 21.

Opposing edges 71, 73 define a corresponding channel 75 extending between the back supports 31, 33. The spacing of perimeter edge 71 from inner edge 73 means that the supports 31, 33 are free to flex independently of each other. In other words, supports 31, 33 can have their free ends rotated relative to rear 41 of seat 27 without coming into contact with each other during such independent movements. The seat 27, lower back support 31, and upper back support 33 thus create three independent support zones for a user when seated in chair 21.

By keeping the width of channel 75 relatively small, so that the area of the channels is less than 50 percent of the area of solid material, the back 29 of chair 21 presents a substantially continuous surface 77 for engaging a user's back. This has the advantage of having a relatively large surface area over which the weight of the user's back can be distributed, thereby reducing stress points against the user's back and increasing the user's comfort.

Shell 23 is generally in the form of a molded sheet. The thickness of shell 23 is preferably varied depending on its location on seating surface 26. For example, referring particularly to FIG. 9, shell 23 has thicknesses 57 at rear 41 of seat 21 which is generally greater than thicknesses 59 at front 39 and at free ends 35, 37. The thicker portions of shell 23 indicated by reference numeral 57 correspond to a rear area 61 on seating surface 26. This variation of thicknesses increases the rigidity at the rear area 61 of seating surface 26 to support the user's bottom, while increasing flexibility at the back support 35, 37 and under the user's legs. As such, when the user shifts his or her legs or his or her back, the underlying, thinner portions of shell 23 can passively adjust more readily.

Furthermore since rear area 61 generally receives weight from the user thereon, it is preferably formed out of a solid section of resilient material, or at a minimum, a substantially continuous pattern of the resilient material. The rear area 61 thus is substantially without numerous apertures, vents, or other discontinuities in the resilient material because such discontinuities make the user uncomfortable. In particular such discontinuities "dig into" the parts of the users body resting against the discontinuities. Instead, by keeping rear area 61 substantially continuous, the weight of the user is distributed optimally over substantially all of the surface area of rear area 61, thereby reducing concentration of forces and enhancing the user's comfort. In the preferred embodiment, portions of channel 75 interrupt the otherwise solid and planar rear area 61 in only two lateral locations.

Figure 7:
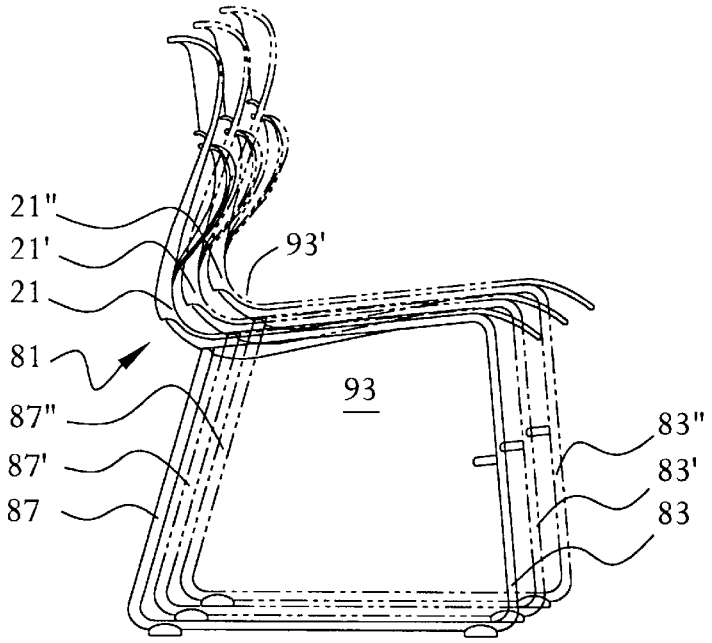
FIG. 7 is a side elevation view showing several of the chairs of FIGS. 1–6 stacked in a telescoped fashion.

Base 25 of chair 21 is preferably a frame made from multiple, interconnected frame members 79. Members 79, as detailed below, are arranged so that chair 21 fits over a second, identical chair, allowing chair 21 to be stacked in a telescoping fashion underneath a second identical chair referred to herein as 21', thereby forming a stack 81 of chairs 21, as shown in FIG. 7. (Features of chair 21' will be referred to by primed reference numerals corresponding to the numerals of chair 21.) Because the base or frame 25 of the chairs 21, 21' are telescoped, the resulting stack 81 saves space when storing multiple chairs 21.

Figure 6:
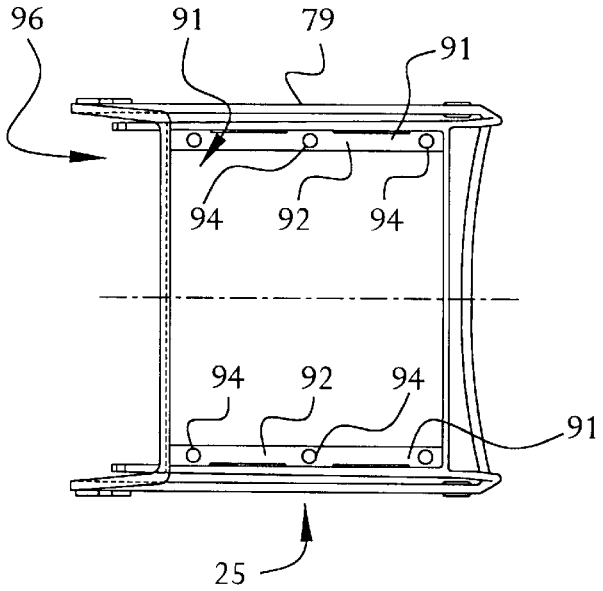
FIG. 6 is a top plan view of the frame portion of the chair of the preceding figures.

As best as seen in FIGS. 4–6, base or frame 25 includes a pair of front legs 83 spaced from each other by a first width 85, and a pair of rear legs 87 spaced from each other by a second width 89. The separation between the rear legs 87 is greater than the separation between the front legs 83. Frame 25 further comprises a seat mount 91 (FIG. 6) to which shell 23 is secured as described subsequently. Legs 83, 87 and seat mount 91 together define a space 93 under seat 27. As best as seen in FIGS. 4 and 5, rear legs 87 partly define an opening 95 through which space 93 can be accessed. As seen in FIGS. 3 and 4, the space 93 does not have any frame member 79 extending through it. These same features in chair 21' mean that space 93' of chair 21' is sufficiently large to receive substantially all of seat 27 and base 25 therein (FIG. 7).

The stacking of chairs 21 and 21' is further facilitated by having legs 83, 87 flare outwardly from the sides of seat 27 as they extend downward from seat mount 91, as best as seen in FIGS. 5 and 6. By flaring the legs 83, 87 outwardly from the sides of seat 27, even slightly, footprint 96 defined by the legs at their lower portions 97 is larger than the footprint 90 (FIG. 6) adjacent to seat mount 91. With regard to chair 21', it will be appreciated that the larger footprint 96' at the lower portions 97' of legs 83', 87' will facilitate placement of chair 21' onto chair 21 in a stacking, telescoped relationship. Thus, chair 21' may be telescoped and stacked upon chair 21 in either of two ways. Chair 21' can be vertically lowered onto chair 21, during which the larger footprint defined by lower leg portions 97' goes around the smaller footprint at seat 27 of chair 21. The chair 21' is lowered until the bottom surface of its seat 27' comes into contact with seat 27 of chair 21.

Another way to stack chairs 21 and 21' is to orient the two chairs so that the front legs 83 of chair 21 are received through space 93' defined by rear legs 87' of chair 21'. During this insertion process, chair 21' need merely be slightly elevated so that its L-shaped shell 23' clears the shell 23 of chair 21. The rear legs 87' of chair 21' continue to be moved rearward over chair 21 until back 29' of chair 21' encounters back 29 of underlying chair 21. Telescoping the chairs 21, 21' by either method achieves the same formation of stack 81, as shown in FIG. 7. In addition, stack 81 can be formed of any number of the chairs 21, and FIG. 7 shows three chairs 21, 21', 21" in telescoped, stacked relationship to each other.

Frame members 29 are preferably made out of metal wires or tubes sized to give frame 25 sufficient strength to support the weight range of users likely to be seated on chair 21. Alternative materials, such as composites, may also be used to create frame or base 25.

Although in this preferred embodiment, L-shaped shell 23 is a one piece, integral, molded shell of polymeric material, shell 23 can also be made of a single sheet of plywood or other laminate structures with suitable resilient characteristics.

Seat mount 91 includes a pair of steel rails 92 with apertures 94 defined therein. (FIG. 6). Referring now to FIGS. 10*a* and 10*b*, seat 27 has studs 98 corresponding to apertures 94, one of which studs 98 is shown in FIG. 10*a* adjacent its corresponding aperture 94. Studs 98 are inserted through apertures 94 and suitable fastenings means, such as locking rings 99 (FIG. 10*b*) are frictionally engaged around studs 98 to hold shell 23 secure to frame or base 25. Other fastenings means and techniques can be used to secure shell 23 to base 25, provided the resilient characteristics of shell 23 are maintained when it is mounted on base 25.

Figure 11:
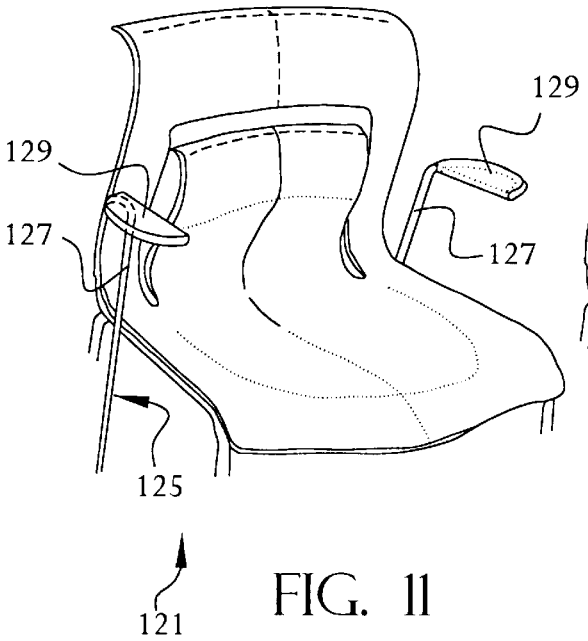
FIG. 11 is a perspective view of a first alternative embodiment of the present invention.

Although the principles of the present invention have been illustrated with the particular embodiment shown in FIGS. 1–10, alternative versions and embodiments are also within the scope of the present invention. For example, FIG. 11 illustrates a first alternative embodiment in which frame 125 has upwardly extending arms 127 with arm rests 129 mounted thereto in a substantially horizontal position. By using only a single arm 127 extending upwardly from the base 25, the resulting arm chair 121 is able to be stacked and telescoped on other, identical arm chairs 121 in a manner similar to that disclosed with reference to chairs 21 and 21'. The other features of arm chair 121 are essentially the same as those described with reference to chair 21.

Figure 12:
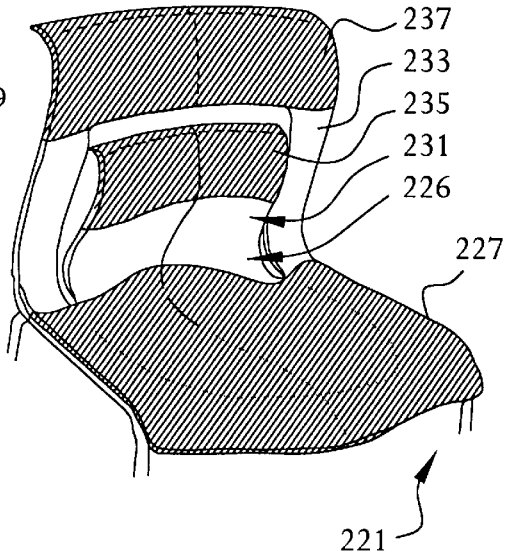
FIG. 12 is a perspective view of a second alternative embodiment of the present invention.

Referring now to FIG. 12, a second, alternative embodiment of the present invention applies upholstery to part or all of seating surface 226 of chair 221. In this case, upholstery has been applied to the upper surface of horizontal seat 227, and to free ends 235, 237 of respective lower and upper back supports 231 and 233. The chair 221 is otherwise similar to those of the previous embodiments.

Figure 14:
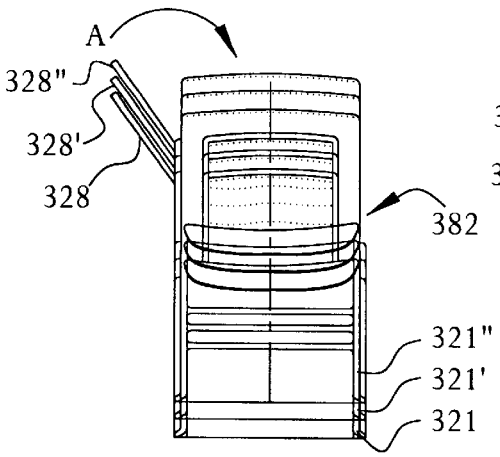
FIGS. 13 and 14 are perspective and front elevation views, respectively, of a third alternative embodiment according to the present invention.
Figure 13:
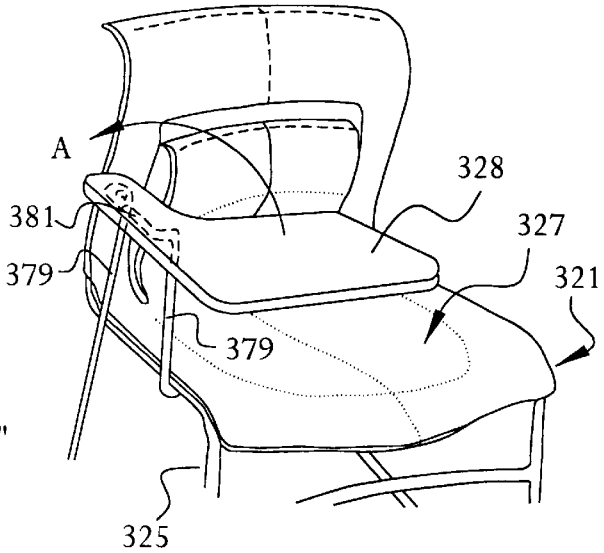

FIGS. 13 and 14 illustrate a third, alternative embodiment of the present invention, in which chair 321 is equipped with a writing tablet 328. Base or frame 325 includes additional members 379 which extend upwardly from one of the sides of horizontal seat 327 to support writing tablet 328 at a predetermined height above it. Writing tablet 328 is mounted to additional frame members 379 so that it rotates generally in the direction shown by arrows A between a closed position over the seat (FIG. 13) for writing and related activities, and an open position (FIG. 14) away from the seat to enable a user to easily sit down on and stand up from the seat. One suitable method for securing writing tablet 328 to additional frame members 379 is to affix a brace or sleeve (not shown) to the substantially horizontal member 381 on which writing tablet 328 rests.

Importantly, additional frame members 379 do not extend over the vertical footprint of horizontal seat 327. In this way, when writing tablet 328 is in the open position, multiple, identical chairs 321, 321', 321" can be telescoped one atop the other to form a space-saving stack 382. The corresponding writing tablets 328, 328', 328" do not interfere with the telescoping of the multiple chairs 321, and in fact also form a stack 384 of overlying writing tablets 328, 328', and 328".

Figure 15A:
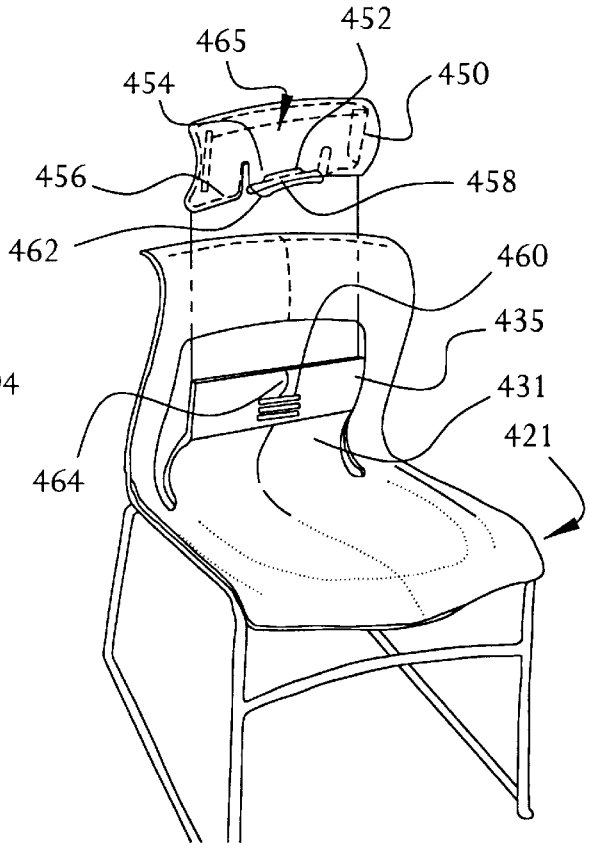
FIG. 15A is a perspective, exploded view of a fourth alternative embodiment according to the present invention.

FIG. 15 illustrates a further alternative embodiment, in which the lower back support further comprises a cap 450 which is sized to fit over free end 435 of lower back support 431. Cap 450 can be moved vertically relative to lower back support 431 so that its location is adjusted to suit the particular user's back anatomy. In particular, cap 450 has a resilient tab 452 in the forward surface 454 of cap 450. Resilient tab 452 has an inner surface 456 with a locking tooth 458 extending inwardly therefrom. Free end 435 of lower back support 431 has multiple, substantially horizontal ridges 460 defined at vertically spaced locations thereon. The ridges may be comprises of outwardly directed projections or recesses as is convenient during manufacture since they both function in an equivalent manner. The size of the locking tooth is selected so that it can engage between adjacent ridges 460.

Resilient tab 452 has a handle 462 defined in its outer surface 464. The handle 462 and locking tooth 458 are integrally connected in this embodiment. Thus, when the handle 462 is pulled, the resilient tab 452 flexes and disengages locking tooth 458 from between two of the ridges 460. Cap 450 is then free to move vertically in relation to free end 435, thereby allowing its vertical location to be adjusted. When the desired vertical location has been determined, the user releases handle 462, and the resilience of tab 452 returns locking tooth 458 into engagement between corresponding ridges 460, to fix the relative position of cap 450.

Vertical movement of cap 450 is regulated and limited in relation to free end 435 by suitable limit means, in this case a vertical slot 464 defined in free end 435 and a corresponding control pin 466 slidably received in slot 464. Chair 421 thus has a lower back support 431 which is adjustable to the needs of particular users. Otherwise, chair 421 is substantially the same as discussed with reference to the embodiment shown in FIGS. 1–10.

Figure 17:
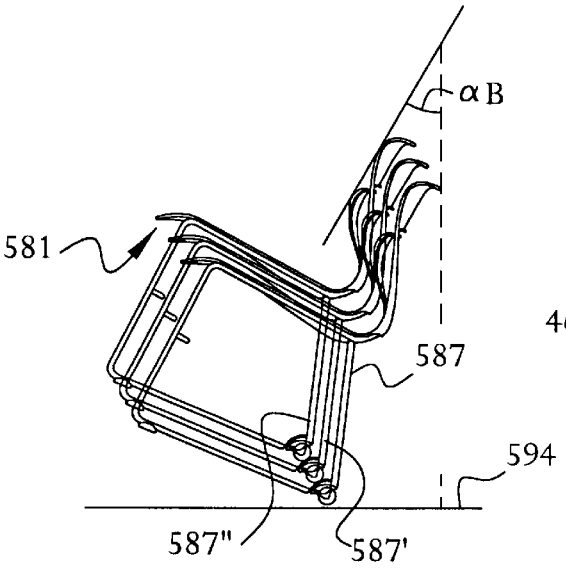
FIGS. 16 and 17 are side elevation views of a fifth alternative embodiment according to the present invention.
Figure 16:
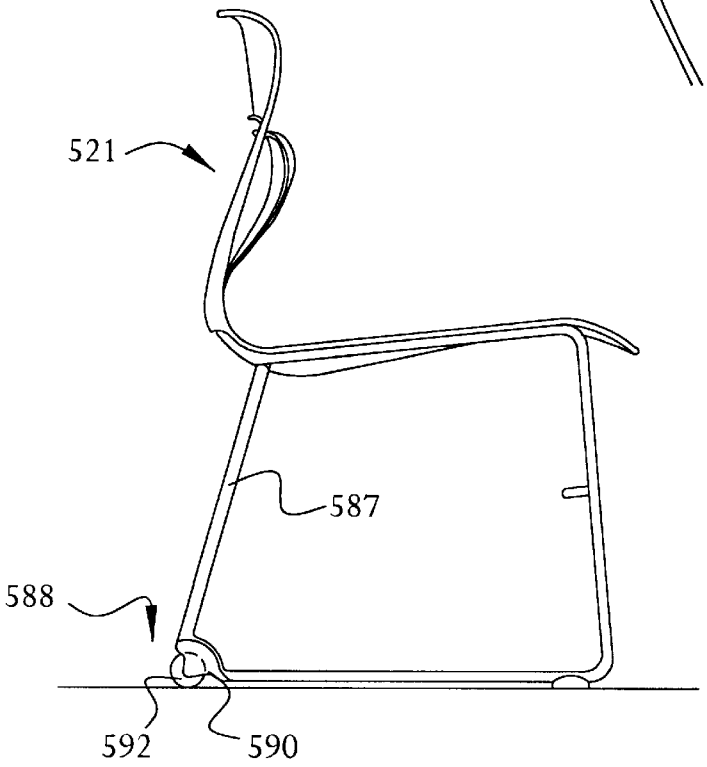

FIGS. 16 and 17 show yet another alternative embodiment to the ergonomic chair 21. Chair 521 shown in FIGS. 16 and 17 has rear legs 587 with casters 588 mounted at lower ends 589 of rear legs 587. The mount 590 in which caster wheel 592 rolls overlies or obscures an arc of less than 90 degrees of caster wheels 592. In this way, when chair 521 is tilted backward onto its rear legs 587 by an angle B (FIG. 17), casters 588 remain able to roll on horizontal surface 594.

Chair 521 is otherwise identical to chair 21 discussed previously. As such, chair 521 is able to be telescoped and stacked with identical chairs 521 to form a stack 581 (FIG. 17). Unlike the previous embodiments, however, the stack 581 can be readily transported as a unit by tilting it back so that the stack 581 rests on the rear legs 587 of the lowermost chair 521 of stack 581. The stack can then be rolled on the casters 588 of such lowermost chair 521 to the desired position.

Still other alternative embodiments can be contemplated within the scope of the present invention. For example, the arrangement of frame members of base 25 can be varied to suit particular applications. Instead of connecting the legs of the frame by horizontal, lower webs as shown in FIGS. 1–10, the frame 25 can be equipped with a set of arcuate runners (not shown) so that the ergonomic chair comprises a rocking chair.

A pedestal with legs or casters in a star-shaped configuration (not shown) can also replace the frame of elongated frame members discussed in the preferred embodiments above.

In addition to the advantages apparent from the foregoing description, the ergonomic chair according to the present invention has a resilient seating surface which creates a passive ergonomic environment which self-adjusts to the body shape and weight of the user.

As a further advantage, when the user changes his or her work activity while seated in the chair of the present invention, the support provided by the resilient shell varies accordingly, reducing points of pressure on the user and thus providing better blood circulation. The better blood circulation, in turn, reduces fatigue and allows for prolonged seating which is more comfortable.

The invention has the advantage of being simple to manufacture, the resilient shell being preferably formed from an integral piece of polymeric material.

The invention has the further advantage of providing a passive ergonomic environment while at the same time permitting the chairs to be telescopically stacked one atop another, thereby saving space when multiple chairs are being stored.

The present invention may be embodied in other specific forms without departing from the spirit or essential attributes thereof and, accordingly, the described embodiments are to be considered in all respects as being illustrative and not restrictive, with the scope of the invention being indicated by the appended claims rather than the foregoing detailed description. The scope of the invention, as well as all modifications thereto which may fall within a range of equivalency, are intended to be embraced by the appended claims.

What is claimed is:

1. An ergonomic chair comprising:

an L-shaped shell formed from an integral piece of resilient material;

a base having means for securing said shell thereto to define a generally horizontal seat and a generally vertical back, said seat having a front, a rear, and sides edges extending between said front and said rear, said rear having outer portions adjacent said side edges and a middle portion between said outer portions;

and a lower back support defined in said back, said lower back support having a base secured to said middle portion of said rear and having a surface extending generally upwardly therefrom to terminate in an upwardly extending, first free end, said surface having a curved contour, said first free end resiliently flexing in relation to said base when weight or force from a user is applied to said lower back support.

2. A chair as defined in claim 1 further comprising an upper back support defined in said back and including a pair of bands and a support section bridging said bands, said bands having fixed ends secured to said outer portions of said rear, said bands extending generally upwardly therefrom, said support section secured to said bands to define a second free end, said second free end resiliently flexing in relation to said rear when weight or force from a user is applied to said upper back support.

3. A chair as defined in claim 1 wherein said shell is formed of molded, polymeric material.

4. A chair as defined in claim 1 for stacking with a second, identical chair, said chair further comprising a pair of arm rests, means for securing said armrests at said side edges of said seat, and means for permitting the armrests of said identical chair to be stacked on top of said armrests of said chair.

5. A chair as defined in claim 1 further comprising a writing tablet;

means for rotatably securing said writing tablet at a predetermined height at one side of said seat, said writing tablet rotating between a closed position over said seat for writing and related activities, and an open position away from said seat to enable a user to easily sit down on and stand up from said seat; and means for permitting said chair to be telescoped with other identical chairs when said writing tablet is in said open position.

6. A chair as defined in claim 1 wherein said seat and said back define a seating surface against which a user may be seated, and wherein said seating surface is at least partially covered with upholstered material.

7. A chair as defined in claim 1 wherein said chair is adapted to be telescopically received on additional identical chairs to form a space-saving stack of chairs which includes a lowermost chair, wherein said base includes a pair of rear legs, and further comprising casters mounted at lower ends of said rear legs, said casters located on said lower ends to roll when said chair is tilted back on said rear legs, and the stack of identical chairs being moveable by tilting back said stack and rolling said stack on said casters of said lowermost chair of said stack.

8. A chair as defined in claim 1 for stacking with a second, identical chair, wherein said base comprises means for telescopically receiving said seat of said second chair therein so that said chair may be stacked on said second chair in a space-saving configuration.

9. A chair as defined in claim 8, wherein said means for telescopically receiving said seat of said second chair comprises a frame formed from a plurality of interconnected members, said members including a pair of front legs spaced from each other by a first width and a pair of rear legs spaced from each other by a second width greater than said first width, a space under said seat of said chair defined by said legs, said rear legs partly defining an opening to said space, the front legs of said second chair being insertable through said opening defined between said rear legs of said chair, said space defined below said seat being sized to receive substantially all of the seat and the frame of said second chair therein.

10. A chair as defined in claim 1 wherein said seat and said back define a seating surface against which a user maybe seated, said curved contour of said lower back support comprises a first portion that is convex in relation to said seating surface, and said first portion located at said free end of said lower back support.

11. A chair as defined in claim 10 wherein said curved contour comprises a second portion that is concave in relation to said seating surface, said second portion located between said first portion and said rear of said seat, and said concave and said convex portions define a serpentine shape sized generally to follow a corresponding S-shaped curve of said user's lower back.

12. A chair as defined in claim 1 wherein said seat and said back define a seating surface against which a user maybe seated, said seating surface having a rear area, and said rear area comprising a substantially continuous pattern of said resilient material so as to distribute weight evenly over substantially all of said rear area.

13. A chair as defined in claim 12 wherein rear area is solid material with channels defined therein, and said area of said channels being less than 50 percent of said area of said solid material.

14. A chair as defined in claim 1 wherein said shell has a variable thickness.

15. A chair as defined in claim 14 wherein the thickness at said rear of said seat is greater than at said free end of said lower back support.

16. A chair as defined in claim 1 further comprising a cap fitted over said free end of said lower back support, and means for vertically adjusting the location of said cap.

17. A chair as defined in claim 16 wherein said adjusting means comprises a resilient tab defined in said cap and multiple, substantially horizontal ridges defined at vertically spaced locations on said free end, said tab having an inner surface with a locking tooth extending inwardly therefrom and sized to engage between adjacent ones of said ridges, said tab having an outer surface with a handle defined thereon, and said locking tooth being disengaged by pulling on said handle.

18. An ergonomic chair comprising a frame formed from a plurality of interconnected members, said frame having a seat mount and legs extending downward from said seat mount and supporting said seat mount at a predetermined height;

a shell secured to said frame, said shell formed from an integral piece of resilient, polymeric material and molded to be substantially L-shaped, said shell comprising a seat and a back, said seat having a front, a rear, and side edges extending between said front and said rear, said rear having outer portions adjacent said side edges and a middle portion between said outer portions; a lower back support defined in said back, said lower back support having a base secured to said middle portion of said rear and having a surface extending, generally upwardly therefrom to terminate in an upwardly extending, first free end, said surface having a curved contour, said first free end resiliently flexing in relation to said base when weight or force from a user maybe applied to said lower back support;

an upper back support defined in said back and including a pair of bands and a support section bridging said bands, said bands having fixed ends secured to said outer portions of said rear, said bands extending generally upwardly therefrom, said support section secured to said bands to define a second free end, said second free end resiliently flexing in relation to said outer portions when weight or force from a user maybe applied to said upper back support;

said lower and upper back supports having corresponding lower and upper back support surfaces, said lower back support surface generally lying in a plane which is closer to said front of said chair than said upper back support surface when said chair is empty; wherein said upper and lower support surfaces flex independently of each other in response to weight and other forces exerted against said surfaces by said user's back resting thereon, said flexing of said support surfaces including rotation of said free ends in relation to said rear of said seat, whereby said seat, said upper back support, and said lower back support comprise three independent support zones;

wherein said seat and said back define a seating surface against which said user is seated, and wherein said curved contour of said lower back support comprises a first portion that is convex in relation to said seating surface, said first portion located at said free end of said lower back support;

wherein said curved contour comprises a second portion that is concave in relation to said seating surface, said second portion located between said first portion and said rear of said seat, said concave and said convex portions defining a serpentine shape sized generally to follow the corresponding S-shaped curve of said user's lower back; and wherein said shell has a variable thickness which is greater at said rear of said seat than at said free end of said lower back support.

19. An ergonomic chair adapted to telescope with a second, identical chair, said chair comprising:

a frame formed from a plurality of interconnected members, said frame having a seat mount and legs extending downward from said seat mount and supporting said seat mount at a predetermined height;

a shell secured to said frame, said shell formed from an integral piece of resilient material and molded to be substantially L-shaped, said shell comprising a seat and a back, said seat having a front and a rear, and sides edges extending between said front and said rear, said rear having outer portions adjacent said side edges and a middle portion between said outer portions;

a lower back support defined in said back, said lower back support having a base secured to said middle portion of said rear and having a surface extending generally upwardly therefrom to terminate in an upwardly extending, first free end, said surface having a curved contour, said first free end resiliently flexing in relation to said base when weight or force from a user may be applied to said lower back support;

an upper back support defined in said back and including a pair of bands and a support section bridging said bands, said bands having fixed ends secured to said outer portions of said rear, said bands extending generally upwardly therefrom, said support section secured to said bands to define a second free end, said second free end resiliently flexing in relation to said outer portions when weight or force from a user maybe applied to said upper back support;

said lower and upper back supports having corresponding lower and upper back support surfaces, said lower back support surface generally lying in a plane which is closer to said front of said chair than said upper back support surface when said chair is empty;

wherein said upper and lower support surfaces flex independently of each other in response to weight and other forces exerted against said surfaces by said user's back resting thereon, said flexing of said support surfaces including rotation of said free ends in relation to said rear of said seat, whereby said seat, said upper back support, and said lower back support comprise three independent support zones; and wherein said lower back support-has a perimeter edge and said upper back support has an inner edge opposing and located near said perimeter edge, said opposing edges defining a corresponding channel therebetween in said back, said back thereby presenting a substantially continuous surface to said user's back to distribute said weight thereof; wherein said legs of said frame include a pair of front legs spaced from each other by a first width and a pair of rear legs spaced from each other by a second width greater than said first width, said legs and said seat mount defining a space under said seat of said chair, said rear legs partly defining an opening to said space, the front legs of said second chair being insertable through said opening defined between said rear legs of said chair, said space defined below said seat being sized to receive substantially all of the seat and the frame of said second chair therein, whereby said chair is telescopically received on top of said second identical chair.

* * * * *